US009296250B2

(12) United States Patent
Rolion et al.

(10) Patent No.: US 9,296,250 B2
(45) Date of Patent: Mar. 29, 2016

(54) RETRACTABLE TIP WRITING INSTRUMENT WITH A PROTECTIVE SLEEVE

(71) Applicant: Societe BIC, Clichy (FR)

(72) Inventors: Franck Rolion, Asnieres sur Oise (FR); Ludovic Fagu, Noisy le Sec (FR)

(73) Assignee: SOCIÉTÉ BIC, Clichy (FR)

( * ) Notice: Subject to any disclaimer, the term of this patent is extended or adjusted under 35 U.S.C. 154(b) by 76 days.

(21) Appl. No.: 14/376,262

(22) PCT Filed: Jan. 16, 2013

(86) PCT No.: PCT/FR2013/050098
§ 371 (c)(1),
(2) Date: Aug. 1, 2014

(87) PCT Pub. No.: WO2013/114017
PCT Pub. Date: Aug. 8, 2013

(65) Prior Publication Data

US 2014/0376987 A1 Dec. 25, 2014

(30) Foreign Application Priority Data

Feb. 3, 2012 (FR) ..... 12 51022

(51) Int. Cl.

| | |
|---|---|
| ***B43K 24/08*** | (2006.01) |
| ***B43K 7/12*** | (2006.01) |
| ***B43K 8/24*** | (2006.01) |
| ***B43K 5/17*** | (2006.01) |
| ***B43K 23/12*** | (2006.01) |

(52) U.S. Cl.
CPC ..... *B43K 24/084* (2013.01); *B43K 5/17* (2013.01); *B43K 7/12* (2013.01); *B43K 8/24* (2013.01); *B43K 23/12* (2013.01)

(58) Field of Classification Search
CPC ..... B43K 5/17; B43K 8/24; B43K 23/12; B43K 24/026; B43K 24/084
USPC ..... 401/110, 111, 117
See application file for complete search history.

(56) References Cited

U.S. PATENT DOCUMENTS

| | | | | | |
|---|---|---|---|---|---|
| 316,402 | A * | 4/1885 | Rubin | B43K 21/20 | 401/117 |
| 832,981 | A * | 10/1906 | Kennedy | B43K 5/17 | 15/172 |
| 866,148 | A * | 9/1907 | Levingston | B43K 24/026 | 15/435 |
| 928,312 | A * | 7/1909 | Lloyd | B43K 24/026 | 279/76 |
| 933,248 | A * | 9/1909 | Grant | B43K 5/17 | 279/79 |

(Continued)

FOREIGN PATENT DOCUMENTS

| | | |
|---|---|---|
| FR | 1 159 302 | 6/1958 |
| FR | 2 103 492 | 8/1971 |

(Continued)

*Primary Examiner* — David Walczak
*Assistant Examiner* — Bradley Oliver
(74) *Attorney, Agent, or Firm* — Polsinelli

(57) ABSTRACT

A writing instrument including a hollow body extending between a rear end and a front end of the hollow body; a writing member mounted inside the hollow body and provided with a tip at a free end; a protective sleeve movable between a tip protection position and a retracted position for writing; at least one first stop formed on the hollow body; and at least one locking member able to engage said first stop.

13 Claims, 3 Drawing Sheets

(56) References Cited

U.S. PATENT DOCUMENTS 1,355,026 A * 10/1920 Austin ..... A46B 11/0013 15/169
1,493,833 A * 5/1924 Wade ..... B43K 24/026 401/117
1,805,347 A * 5/1931 Weingart ..... B43K 5/17 401/108
2,435,185 A * 1/1948 Reynolds ..... B43K 7/005 401/117
2,941,511 A 6/1960 Cieremans
3,289,638 A * 12/1966 Levoin ..... B43K 24/084 401/110
3,740,159 A * 6/1973 Smagala-Romanoff . B43K 7/12 249/134
3,741,665 A * 6/1973 Smagala-Romanoff . B43K 7/12 401/117
4,580,919 A * 4/1986 Ambasz ..... B43K 7/005 24/11 F
4,595,307 A * 6/1986 Heyden ..... B43K 23/10 401/117
4,780,016 A * 10/1988 Kim ..... B43K 23/12 401/116
4,896,983 A * 1/1990 Im ..... B43K 23/126 401/107
6,273,627 B1 * 8/2001 Mittersinker ..... B43K 5/17 401/109
6,752,557 B1 * 6/2004 Hsieh ..... B43K 24/04 401/104
6,921,225 B1 * 7/2005 Hsu ..... B43K 7/005 401/104
2004/0213622 A1 * 10/2004 Kageyama ..... A45D 40/18 401/31
2005/0078999 A1 * 4/2005 Kato ..... B43K 7/005 401/117
2007/0274764 A1 * 11/2007 Shim ..... A45D 34/04 401/108
2008/0008517 A1 * 1/2008 Wang ..... B43K 5/005 401/107
2008/0095568 A1 * 4/2008 Hsien ..... B43K 24/084 401/115
2009/0169285 A1 * 7/2009 Cabatan ..... B43K 23/00 401/109
2010/0067971 A1 * 3/2010 Zhao ..... B43K 23/12 401/195
2010/0150638 A1 * 6/2010 Namiki ..... B43K 7/12 401/99
2010/0196080 A1 * 8/2010 Challman ..... B43K 8/028 401/109
2011/0027000 A1 * 2/2011 Paradise ..... B43K 23/00 401/107
2011/0129285 A1 * 6/2011 Liu ..... B43K 7/005 401/117
2012/0003030 A1 * 1/2012 Kish ..... B43K 23/12 401/202
2015/0050062 A1 * 2/2015 Rolion ..... B43K 7/12 401/114
2015/0125199 A1 * 5/2015 Peyton ..... B43K 7/12 401/213
2015/0224812 A1 * 8/2015 Cheon ..... B43K 8/03 401/104
2015/0298489 A1 * 10/2015 Kamitani ..... B43K 7/02 401/142
2015/0321502 A1 * 11/2015 Peyton ..... B43K 7/005 401/213

FOREIGN PATENT DOCUMENTS

GB 1 007 198 10/1955
GB 2 446 132 A 6/2008

* cited by examiner

RETRACTABLE TIP WRITING INSTRUMENT WITH A PROTECTIVE SLEEVE

CROSS REFERENCE TO RELATED APPLICATION

This application is a national stage application of International Application No. PCT/FR2013/050098, filed on Jan. 16, 2013, which claims the benefit of French Patent Application No. 1251022 filed on Feb. 3, 2012, the entire contents of both applications being incorporated herein by reference.

BACKGROUND OF THE INVENTION

1. Field of the Invention

The embodiments of the present invention relate to a writing instrument such as an ink pen. For example, the writing instrument may include: a hollow body, typically tubular, extending between a rear end and a front end; a writing member mounted inside the body and provided with a tip at a free end; a protective sleeve movable between a tip protection position (position in which a protective end of the sleeve extends towards the front of the body, completely covering the tip) and a retracted position for writing (position in which the tip protrudes towards the front from the protective sleeve through an opening); at least one first stop formed on the body; and at least one locking member able to engage the first stop in order to maintain the protective sleeve in one of its two positions.

2. Description of Related Art

A writing instrument of the type mentioned above eliminates the use of a detachable cap that can be lost, while providing protection for the writing tip. For example, document FR 2,103,492 describes a writing instrument having a protective sleeve with a substantially conical front end and in which the retracted position for writing is maintained by the introduction of a locking protrusion within a recess or groove formed on the outer face of the tubular body. This type of protective sleeve has a spring clip provided with a ridged area to allow the user to push the protective sleeve rearward into the retracted position for writing, where the locking member engages. The elasticity of the spring clip allows raising the protective sleeve then pushing it forward to return to the protection position.

For this type of operation, a thinning of the release clip (reduced thickness at the clip connection) is required in order for it to be flexible, which increases the risk of clip breakage. In addition, it can be more difficult to hold the writing instrument because of the presence of the release clip.

SUMMARY OF THE INVENTION

The embodiments of the present invention aim to provide, for example, a writing instrument with a retractable protective sleeve having a reliable mechanism and that is simple in design.

For this purpose, a writing instrument according to an embodiment of the present invention includes at least one second stop formed on the body and axially offset towards the front end with respect to said first stop, the first stop and the second stop being part of a fixed cam; a rotary cam which includes said at least one locking member and is movable relative to the body between: a withdrawn position where said locking member engages with said first stop in order to lock the refracted position, and an extended position where said locking member engages with said second stop in order to lock the protection position, an elastic return element or biasing the protective sleeve towards said protection position; and a coupling between the protective sleeve and the rotary cam, so that the protective sleeve forms a tappet actuating a movement of the rotary cam to one or the other of said extended and withdrawn positions in alternation.

Thus, in response to a rearward pressure exerted on the protective sleeve, the protection position and the retracted position can be actuated and locked in an alternating manner.

Because of the elastic return element, locking the respective positions (retracted position and protection position) is achieved with no further action from the user. It is also interesting to note that it is the protective sleeve which forms the actuator, the rotary cam turning to one or the other of the locking positions in response to the rearward movement of the protective sleeve. It is therefore understood that the body can be smooth (with no clip or button protruding from the sides) and the actuating part formed by the protective sleeve can then be particularly robust.

For a writing instrument that is more comfortable and more ergonomic, the protective sleeve can have a protection portion with at least one indentation on its outer surface. This facilitates grasping the protective sleeve between two fingers. For example, the user can move the protective sleeve by squeezing it between the index and middle 30 fingers, while the body is held in place between the thumb and index finger. The index and/or middle finger enters the indentation(s) to provide a better hold on the protective sleeve. This type of structure allows the user to achieve an efficient rearward pushing action similar to a pushbutton or tappet, in order to actuate the transition of the protective sleeve from one position to the other.

According to one feature of the present invention, the rotary cam extends annularly about an intermediate portion of the writing member (the intermediate portion being axially distant from the front and rear ends of the writing member). The elastic return element may be located further towards the rear relative to the rotary cam, extending at least partially around and/or along the writing member.

According to one feature of the invention, the protective sleeve includes a guide portion sliding along the body on an axis parallel to the longitudinal axis of the hollow body (and preferably coincident with that longitudinal axis), and a protection portion extending the guide portion and having an opening to allow the passage of the tip, the protective sleeve comprising an annular shoulder which defines a rear face of the protection portion, the protective sleeve able to be pushed freely rearward until stopped by the annular shoulder pressing against the front end of the body. This arrangement controls the end of the stroke of the tappet formed by the protective sleeve, with the force exerted on the elastic return element (typically a compressive force in the case of a spring) always being the same. This structure is particularly robust, and the grip of the user on the protective sleeve can be facilitated by the presence of at least one cavity or recess for the fingers.

According to another feature of the present invention, the protective sleeve includes a set of teeth adapted to engage with the rotary cam, said coupling allowing a longitudinal rearward displacement of the rotary cam when the protective sleeve is pushed, causing: when the protective sleeve is pushed from said protection position, a first rotation of the rotary cam such that said locking member engages with said first stop, obtaining and locking the retracted position, and when the protective sleeve is pushed from said retracted position, a second rotation of the rotary cam such that said locking member engages with said second stop, obtaining and locking the protection position, the first rotation and the second rotation occurring in the same direction about the longitudinal axis with substantially the same angle of rotation, which is preferably less than or equal to 45°.

With these arrangements, the rotary cam can rotate due to the cam effect when the protective sleeve reaches the end of its stroke (pressing against the front end of the body), while the reaction force of the elastic return element is at its maximum. It is understood that the transition of the protective sleeve to the next position is rapid after it is pushed rearward, the locking member already being opposite the corresponding stop. The advancement of the rotary cam to its engagement position is triggered simply by the elastic return element returning to position. A plastic washer may optionally be placed between the rotary cam and the elastic return element. Such a washer can be chosen to minimize friction during rotation of the rotary cam.

According to one feature of the present invention, the front end of the body has an opening, the body defining an inside volume, and the protective sleeve is mounted in the body through said opening, the guide portion of the protective sleeve being inserted into the inside volume of the body and extending longitudinally along the longitudinal axis of the body. Thus, because it slides within the hollow body, which is typically tubular, the risk of the protective sleeve becoming stuck is reduced and the actuating mechanism is particularly robust.

According to another feature of the present invention, the elastic return element includes a spring, preferably helical, located entirely within the inside volume of the hollow body and having: a rear end bearing in a fixed manner against a supporting face; and a front end bearing directly or indirectly against the rotary cam.

Preferably, the supporting face is formed on a piston, the writing member being rearwardly movable in translation with the piston within the hollow body, an additional spring being arranged near the rear end of the hollow body, bearing on a rear face of the piston opposite the supporting face, in order to generate a repulsive force which biases the writing member towards the front and is adapted to absorb writing pressure when the protective sleeve is in the retracted position. With these arrangements, the transition of the sleeve to the protection position can be achieved by a frontal push against the front of the writing instrument. Typically in this case the user can use only one hand to press the tip and then the sleeve against a rigid support in a single pushing motion (the tip moving rearward with the sleeve), so that the protection position is obtained when the user stops pushing. The tip then protrudes from the front of the body due to the elastic return of the additional spring (the sleeve remaining locked in the retracted position). The retracted position can be obtained in a similar manner, with the tip flush with the front end of the sleeve. It is understood in this case that the two positions of the instrument are each actuated by the pushback (similar to a "punching" mode in machining) occurring in response to the pressure against a surface initiated by the user's hand.

According to another feature of the present invention, the effect of the repulsive force of the additional spring causes the piston to bear against an internal stop of the body for said protection position and for said retracted position of the protective sleeve, whereby the writing member has the same position relative to the hollow body in both the protection position and the retracted position. This arrangement allows using a greater return force for the additional spring compared to the spring biasing the sleeve, with the advantage that the initial force to push the tip will then be enough to push the sleeve towards the rear, so that the pushing movement to obtain the protection position occurs in one continuous unimpeded movement.

According to another feature of the present invention, the rotary cam is positioned within said inside volume and extends annularly around said longitudinal axis, defining an inside space, the writing member being movable in translation along the longitudinal axis within this inside space. It is thus understood that the writing member can move independently of the protective sleeve, for example to absorb the writing pressure. This axial mobility during writing thus has no impact on the locking of the protective sleeve.

In various embodiments of the present invention, it is possible for one or more of the following arrangements to be used: said first stop and said second stop are defined by at least one pair of adjacent notches extending longitudinally on an inner face of the body and opening axially towards the rear in a same annular area of the body, one of the notches of said pair being longer than the other; said at least one locking member includes a specified number, at least equal to two, of locking teeth, the inner face of the body having a number of first stops at least greater than or equal to the specified number and the number of second stops being identical to the number of first stops; the rotary cam is held alternately in either the extended position in which at least one of the locking teeth is engaged in one of the longer notches, or in the withdrawn position in which at least one of the locking teeth is engaged with one of the shorter notches; the rotary cam includes a body having a generally cylindrical outer surface extending between a rear end, where said at least one locking member is arranged, and a front end; the protective sleeve has a rear end provided with a set of teeth for engagement with the rotary cam; the protective sleeve has an inner face on which is formed an annular retaining groove; the rotary cam includes an external annular bead projecting from said outer surface and engaging said annular retaining groove so that the rotary cam is attached to the protective sleeve with an axial play allowing it to be slidable between a position where the teeth are engaged with the rotary cam and a position where the teeth are disengaged (with such a coupling of the rotary cam with the protective sleeve, this combines on the one hand the rotation caused by the cam effect with a significant longitudinal sliding that makes it possible to obtain the two positions of the sleeve, and on the other hand an indirect biasing of the elastic return element on the protective sleeve so as to obtain each of the positions quickly and efficiently); the rotary cam (preferably formed as one piece) includes at least two protruding projections formed on said outer surface and offset axially rearward relative to the external annular bead, each of the protruding projections having a beveled front face for engaging with the teeth of the protective sleeve, the locking teeth being offset axially rearward relative to the protruding projections; and the front end of the body has an axial opening, the guide portion being inserted into the inner volume of the body and having a male or female rotation-prevention member for engaging with a complementary guide member of the body extending longitudinally to the front end.

DESCRIPTION OF THE DRAWINGS

Other characteristics and advantages of the invention will be apparent from the following description of several embodiments, given as non-limiting examples, with reference to the accompanying drawings in which.

DETAILED DESCRIPTION

In the various figures, identical references denote identical or similar elements. The writing instrument 1 allows writing with any writing, erasing, or highlighting medium, referred to in the following description as ink, by means of a writing tip 2.

Figure 1:
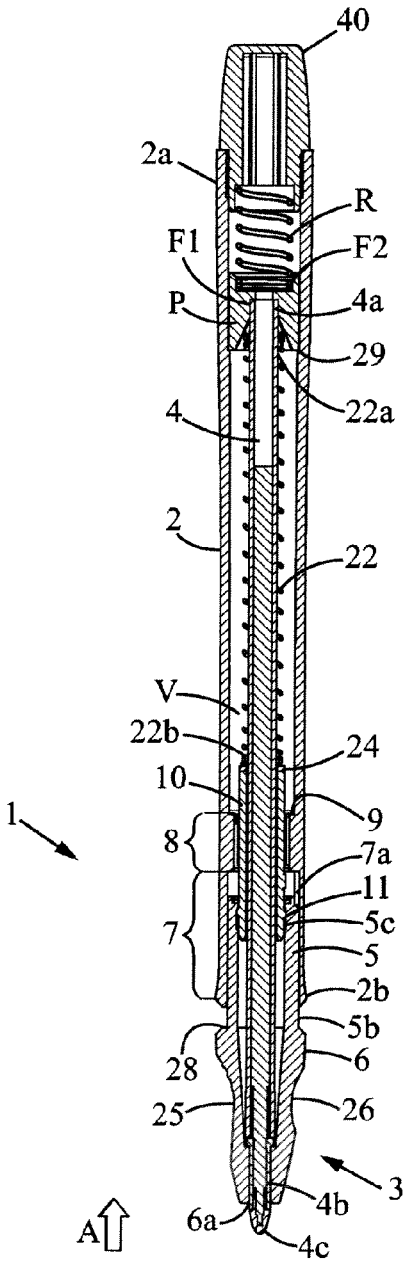
FIG. 1 is a diagram illustrating a longitudinal sectional view of an example of a writing instrument, with the protective sleeve in the retracted position.
Figure 2:
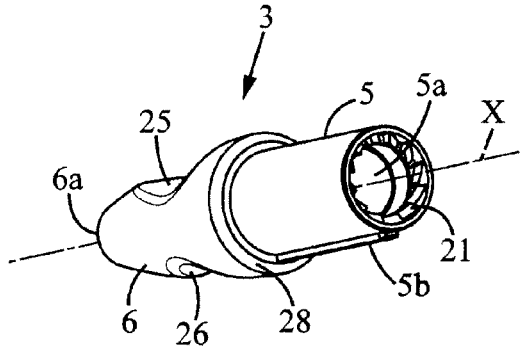
FIG. 2 is a diagram illustrating a perspective view of the protective sleeve of the writing instrument of FIG. 1.

Referring to the example illustrated in FIGS. 1 and 2, the writing instrument 1 includes a hollow body 2, preferably tubular, forming a barrel. This hollow body 2 extends longitudinally (along a longitudinal axis X) between a rear end 2*a* and a front end 2*b* having an opening 2*c* which here is axial. The writing instrument 1 does not have a cap but has a protective sleeve 3 that is movable towards the front of the hollow body 2. The writing member 4 housed 10 inside the hollow body 2 may have a generally cylindrical form as is known, for example forming a cartridge (optionally replaceable by removing the rear end 2*a* of the body 2). It is understood that the longitudinal axis forms a center axis X that passes through the hollow body 2, the protective sleeve 3, and the writing member 4.

The writing member 4 is mounted inside the inner volume V of the hollow body 2, pressing at its rear end 4*a* against a supporting face F1 defined at the front of a piston P.

The front end 4*b* of the writing member 4 has a tip 4*c* located outside the inner volume V and projecting forward from the hollow body 2 as seen in FIG. 1. The supporting face F1 of the piston P has a base which extends transversely to the longitudinal axis of the hollow body 2 and teeth and/or at least one wall extending from the base in order to center the writing member 4 within the inner volume V of the body 1.

Due to the engagement of the rear end 4*a* of the writing member 4 with the piston P, the writing member 4 is movable in translation with the piston P, rearward and forward, within the hollow body 2. A spring R is arranged near the rear end 2*a* of the body 2 and presses against the piston P near the rear face F2 opposite the supporting face F1. This spring R, which is axially compressed, bears against a plug 40 sealing the rear end 2*a* of the body 2 in a known manner. This spring R generates a repulsive force which biases the writing member 4 towards the front and is adapted to absorb writing pressure when the protective sleeve 3 is in the retracted position (the retracted position is clearly visible in FIGS. 1 and 4A).

Referring to FIGS. 1 and 2, the protective sleeve 3 includes a guide portion 5, here generally tubular, which slides along the body 2 within the inner volume V. The guide portion 5 extends forward in a protection portion 6 which has an opening 6*a* to allow the tip 4*c* to pass through. This opening 6*a* is axial. An axial opening 5*a* is also provided at the rear of the guide portion 5. The protective sleeve 3 forms the tapered front end of the writing instrument 1; the protection portion 6 in particular may be conical or of similar shape. The guide portion 5 and the protection portion 6 extend around the same central axis, here coinciding with the longitudinal axis X of the hollow body. The guide portion 5 preferably has a generally cylindrical shape. In variants with a substantially asymmetric hollow body 2, the longitudinal axis X is a center axis for the protective sleeve 3 and for the front portion of the hollow body 2.

As illustrated in FIG. 1, the protective sleeve 3 is mounted in the hollow body through the opening 2*c* formed in the front end 2*b*, so that the guide portion 5 of the protective sleeve 3 is inserted into the inner volume V of the hollow body 2. In the retracted position of the protective sleeve 3 as shown in FIG. 1, the writing member completely traverses the protective sleeve 3 such that the writing instrument 1 is in a writing configuration. The protective sleeve 3 here is formed of a single piece of injection molded plastic. The guide portion 5 of the protective sleeve 3 may be shorter in length than the length of the protection portion 6 which here has a generally conical shape. This minimizes the amount of material used to make the protective sleeve 3.

With reference to the non-limiting example of FIG. 2, it can be seen that the protective sleeve 3 extends longitudinally along a central axis, which typically coincides with the longitudinal axis X of the hollow body 2 (FIG. 1). The guide portion 5 slides within an area defined by a first tubular section 7 of the hollow body 2. A second tubular section 8 of the hollow body 2 extends the first section 7 rearward and has internal ribs 9 such that the internal cross-section of the hollow body 2 narrows at the junction between the first tubular section 7 and the second tubular section 8.

The internal cross-section defined by the first tubular section 7 is constant here and without recesses or protrusions, with the exception of a guide member such as a slot 7*a* which cooperates with a complementary rotation-prevention member 5*b* (male or 25 female) formed on the outer face of the guide portion 5 to prevent rotation of the protective sleeve 3. In this example in FIGS. 1 and 2, the slot 7*a* extends longitudinally to the front end 2*b* of the hollow body 2 and the rotation-prevention member 5*b* is a longitudinal rib which reaches the rear end of the protection portion 6.

Figure 5:
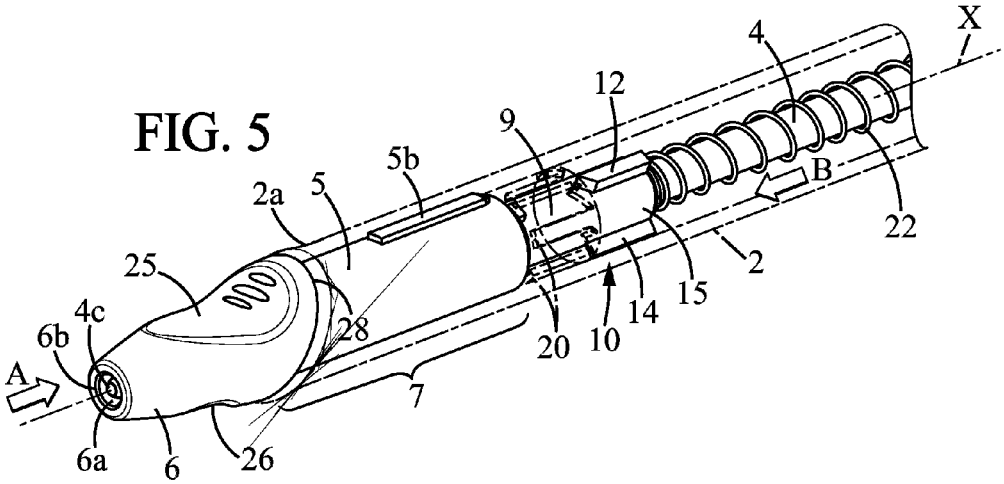
FIG. 5 is a diagram illustrating a perspective view of an alternative embodiment of a portion of the writing instrument.

In another example shown in FIG. 5, it can be seen that the rotation-prevention 30 member 5*b* can be shortened. Here, the guide portion 5 can be fully inserted into the inner volume V of the hollow body 2 while being completely covered by the first tubular section. As will be explained below, this insertion state can be an intermediate state between the two positions (retracted position and protection position) assumed by the protective sleeve 3.

As is clearly visible in FIGS. 1 and 5, the guide portion 5 is extended longitudinally rearwards by a rotary cam 10 arranged coaxially with the protective sleeve 3. The rotary cam 10 is attached to the guide portion 5 of the protective sleeve 3 by a coupling 11. In the embodiment represented, this coupling 11 is achieved by inserting an external annular bead 10*a* of the rotary cam 10 into an annular retaining groove 5*c* formed on the inner face of the guide portion 5.

This coupling 11 allows slight axial play between the rotary cam 10 and the protective sleeve 3 and enables the rotary cam 10 to rotate about the longitudinal axis X (unlike the sleeve 3 which includes the rotation-prevention member 5*b*). This axial play is much less than the axial displacement of the protective sleeve 3, so that the rotary cam moves rearward within the inner volume V when the protective sleeve 3 is pushed towards the rear. Although the example represented shows an external annular bead 10*a* catching in an annular groove 5*c*, it is understood that any other type of coupling can be used to achieve the coupling 11 with axial play, for example by using one or more recesses to retain a complementary projecting member such as a rib.

As shown in the example of FIG. 1, the writing instrument 1 may include only three external tubular parts made of plastic: the hollow tubular body 2, the protective sleeve 3, and the plug 40. The writing member 4, the rotary cam 10, the optional washer 24, and the associated elastic return element, in this case a helical spring 20 22, may also be included in the writing instrument 1. Additionally, the piston P and spring R may or may not be included, as can be seen in another example illustrated in FIG. 8. Accordingly, the number of parts required for the two-position locking system is thus very reasonable, with the additional advantage that the locking system is completely integrated inside the inner volume V of the hollow tube 2.

The rotary cam 10 may include at least one locking member, here several locking teeth 12, 13, 14 distributed along the circumference of a tubular body 15. An inside space 10*b* is defined within the tubular body 15. The writing member 4 completely traverses the tubular body 15 of the rotary cam 10 via this inside space 10*b*, and can optionally slide independently of the movement of the assembly formed by the protective sleeve 3 and rotary cam 10, along the axial direction defined by the longitudinal axis X.

These locking teeth 12, 13, 14 are adapted to engage with a fixed cam defined by the internal ribs 9 of the second section 8. In this fixed cam, the internal ribs 9 are spaced apart to form longitudinal notches 9*a*, 9*b*. Preferably these notches are tapered at the bottom, this tapered shape corresponding to the frontward shape of the locking teeth 12, 13, 14. The second section 8 equipped with the fixed cam may, for example, resemble or have a structure identical to a section used to form the barrel of the BIC Velocity® pen (the position of this second section 8 being very different however because the first and second sections 7, 8 are provided near the front end 2*b* of the hollow body 2 in the writing instrument 1 according to an aspect of the present invention).

Figure 6:
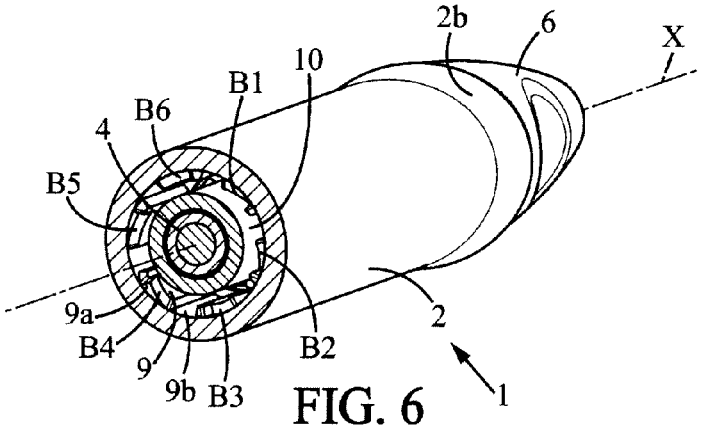
FIG. 6 is a diagram illustrating a detailed view of the writing instrument of FIG. 5.

Referring to FIGS. 5 and 6, the rearward ends of the respective ribs 9 form a series of first stops B1, B2, B3, B4, B5, B6. Here again, it is preferable to have a beveled shape obtained by creating short notches 9*a* at the rear end of the ribs 9. In other words, the series of first stops B1, B2, B3, B4, B5, B6 is defined by the respective bottoms of these short notches 9*a*. A series of second stops 20 is defined by the respective bottoms of the main notches, which are longer 9*b*; the locking teeth 12, 13, 14 engage with these second stops 20 by sliding forwards between two adjacent ribs 9. The short notches 9*a* and the longer notches 9*b* end axially at the rear in the same annular region of the hollow body 2, as is clearly visible in FIG. 6. Of course, other embodiments of the stops and locking members can be envisaged. It is generally understood that the first stops B1, B2, B3, B4, B5, B6 are offset rearward within the hollow body 2 relative to the second stops 20 and that the rotation of the rotary cam 10 allows alternating between engagement with the first stops B1, B2, B3, B4, B5, B6 and engagement with the second stops 20.

Referring now to FIG. 2, the protective sleeve 3 has a set of teeth 21 at its rear end, adapted to engage with the rotary cam 10, particularly with protruding projections 15*a* which project radially outward from the outer surface of the tubular body 15. These projections 15*a* are offset axially rearward relative to the external annular bead 10*a* or similar reliefs for coupling the protective sleeve 3 and the rotary cam 10. These protruding projections 15*a* have a beveled front face for engaging with the teeth 21 of the protective sleeve 3. In a preferred embodiment, the number of teeth 21 may correspond to the total number of the first and second stops B1, B2, B3, B4, B5, B6 and 20. As represented in FIG. 2, the teeth 21 form a ring at the rear end of the guide portion 5, with the recesses opening towards the rear at the axial opening 5*a*.

Figure 7:
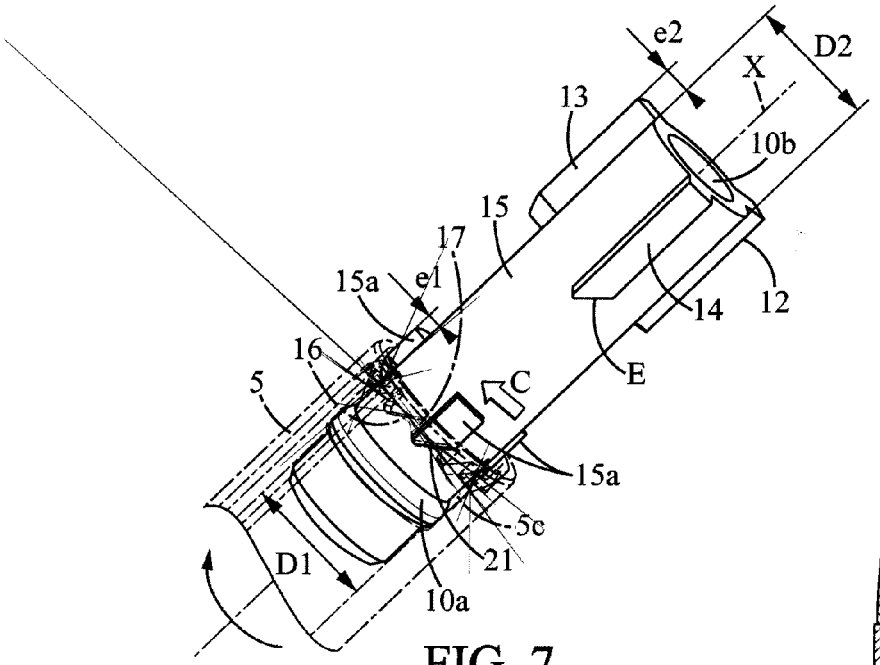
FIG. 7 is a diagram illustrating a detailed side view of the writing instrument of FIG. 1.

By cooperating with the protruding projections 15*a* as illustrated in FIG. 7, the teeth 21 allow initiating an angle of rotation comparable to, and preferably less than or equal to, the angular offset between the notches in a pair of adjacent notches 9*a*, 9*b*. As shown in FIG. 6, the notches of such a pair extend longitudinally along the inner face of the hollow body 2, one of the notches being longer than the other.

When the front ends of the protruding projections 15*a* cooperate with the teeth 21, the front ends E of the axially rearward locking teeth 12, 13, 14 cooperate with the fixed cam of the second section 8 of the hollow body 2. It is understood that the rotary cam here is male, while the fixed cam is female. Via the coupling 11, actuation of a rearward movement of the protective sleeve 3, as illustrated by the arrow A in FIG. 5, causes a rearward displacement of the rotary cam 10, which disengages the locking teeth 12, 13, 14 from the corresponding notches.

This disengagement enables the rotary cam 10 to rotate through a small predetermined angle of rotation (first angle), here much smaller than 45° and for example less than 20°. This slight rotation results from the full insertion (closer contact) of the protruding projections 15*a* into the recesses of the maneuvering teeth 21 as illustrated in FIG. 7 (arrow C). One can see that the set of teeth 21 here includes a series of annularly distributed ramps 16, each extending from a sharp edge or analogous end edge 17 of the teeth 21 to the bottom of the recesses. The protruding projections 15*a* slide along these ramps 16 to generate the slight rotation of the rotary cam 10. Passing beyond the end edges 17 is allowed due to the axial play at the coupling 11, which provides sufficient relative movement between the guide portion 5 of the protective sleeve 3 and the rotary cam 10 to permit further rotational movement as indicated by the arrow C. After this slight rotation, the leading end E of the locking teeth 12, 13, 14 is sufficiently facing the adjacent notch to allow the rotational movement to continue for a second angle well below 45°. In a preferred embodiment, the sum of the first angle and the second angle is approximately 30°, the total number of notches 9*a*, 9*b* being equal to 12 (the number of indentations in the set of maneuvering teeth 21 here being equal to 12).

Figure 3:
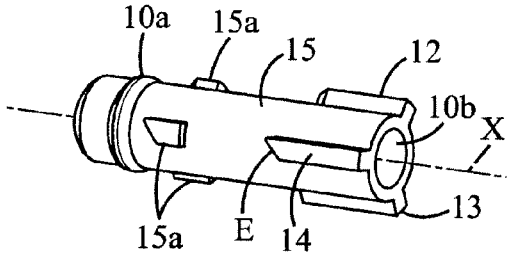
FIG. 3 is a diagram illustrating a perspective view of the rotary cam of the writing instrument of FIG. 1.

Referring to FIGS. 3 and 7, each of the protruding projections 15*a* is aligned with one of the locking teeth 12, 13, 14, and the same tapered shape is used at the front of these reliefs formed on the tubular body 15 of the rotary cam 10. The outer surface of this tubular body 15 is generally cylindrical with a slightly smaller outside diameter D2 than the inside diameter D1 of the guide portion 5. Here, the locking teeth 12, 13, 14 are formed on the rear end of the rotary cam 10 and project radially outwardly in a manner similar to the protruding projections 15. Preferably, the radial extension e2 of the locking teeth 12, 13, 14 is greater than the radial extension e1 of the protruding projections 15*a*. With such a 30 radial extension e2, it is possible to reduce the thickness of the hollow body 2 at the fixed cam (minimizing the extra thickness at the internal ribs 9) and thus save material.

Of course, any other manner of rotating the rotary cam 10 over an angle of less than 45° can be used, for example with a smaller number of notches 9*a*, 9*b* in the fixed cam. Advantageously, to save material, the number of locking teeth 12, 13, 14 or similar locking members is less than the number of first stops B1, B2, B3, B4, B5, B6 and less than the number of second stops 20.

More generally, it is understood that the coupling 11, the arrangement of the fixed cam formed in the second section 8, and the set of teeth 21, allow controlling the movement of the rotary cam 10. The rotary cam 10 thus moves relative to the hollow body 2 while being guided by the internal ribs 9 of the fixed cam, and alternates between a withdrawn position (corresponding to the refracted position of the protective sleeve 3) and an extended position (corresponding to the protection position of the protective sleeve 3).

Figure 4A:
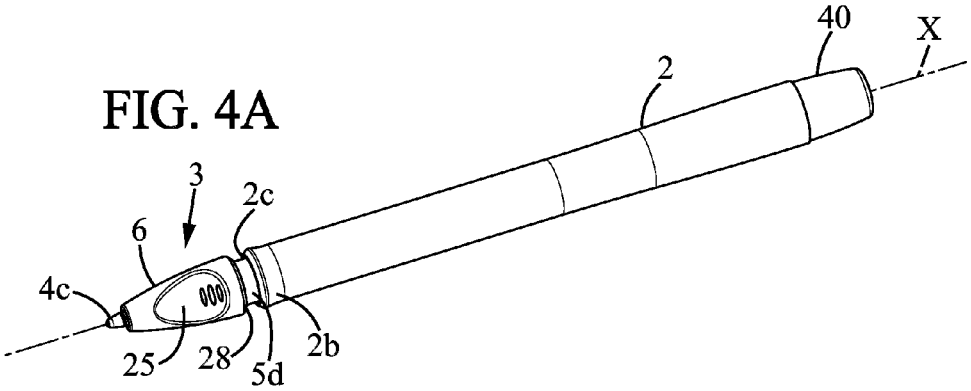
FIG. 4A is a diagram illustrating a perspective view of the writing instrument of FIG. 1, and illustrating the writing position of the protective sleeve.
Figure 4B:
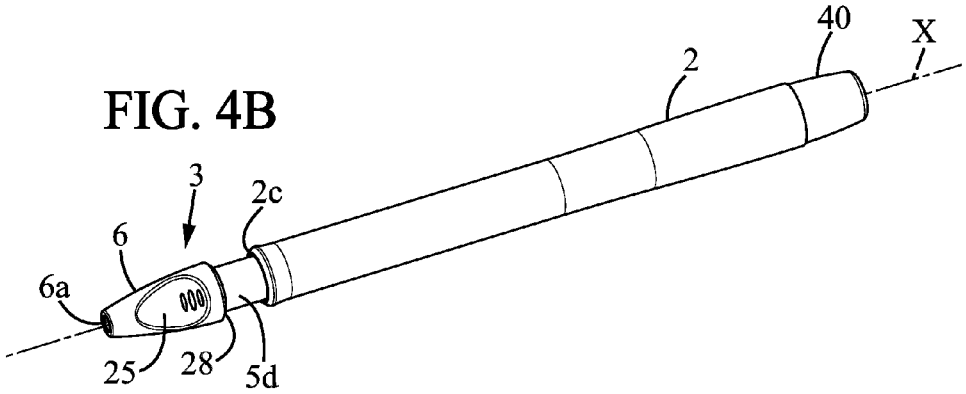
FIG. 4B is a diagram illustrating a perspective view of the writing instrument of FIG. 1, and illustrating the protection position of the protective sleeve.

Furthermore and as illustrated in FIGS. 1 and 5, an elastic return element is provided that bears against the assembly formed by the protective sleeve 3 and the rotary cam 10, biasing the protective sleeve 3 into the protection position shown in FIG. 4B. The return element is for example positioned around the writing member 4. This elastic return element is preferably an actuating spring 22, for example a helical spring, which is compressed axially between the rotary cam 10 (or an additional washer 24 abutting against the rotary cam 10, in the example of FIG. 4) and the piston P slidingly mounted to be integral with the writing member 4. More specifically, one can see that this spring 22, positioned entirely within the inner volume V, may include: a rear end 22*a* bearing in a fixed manner against the supporting face F1 defined by the piston P; and a front end 22*b* bearing directly or indirectly against the rotary cam 10.

Of course, the helical spring could be replaced by an elastic strip integral with the piston P or possibly by a series of multiple springs placed end to end. More generally, any biasing means can be used that exerts a direct or indirect bearing force against the protective sleeve 3. Referring to FIG. 5, it is thus understood that the protection position of the protective sleeve 3 is obtained immediately after the disengagement of the locking teeth 12, 13, 14 from the first stops B1, B2, B3, B4, B5, B6, due to the action of the spring 22 in the direction of arrow B. The locking teeth 12, 13, 14 engage axially with the second stops 20 after sliding between the internal ribs 9 of the fixed cam.

To obtain the retracted position of the protective sleeve 3, the spring 22 acts in a similar manner, the locking teeth 12, 13, 14 then positioned facing the short notches 9*a* being displaced axially against the first stops B1, B2, B3, B4, B5, B6.

Together, the coupling 11 visible in FIG. 1 and the use of a spring 22 allow moving the rotary cam 10 longitudinally in a reciprocating movement (backward and forward) when the protective sleeve 3 is pushed.

More generally, it is understood that the configuration of the rotary cam 10 and the coupling 11 with the protective sleeve 3 allow obtaining, without any rotational movement from the user: when the protective sleeve 3 is pushed from the retracted position, a first rotation of the rotary cam 10 such that the locking teeth 12, 13, 14 or any similar locking member engage with the first stop(s) B1, B2, B3, B4, B5, B6 (withdrawn position of the rotary cam 10), so as to obtain and lock the retracted position, and when the protective sleeve 3 is pushed from said retracted position, a second rotation of the rotary cam 10 such that the locking teeth 12, 13, 14 or any similar locking member engage with the second stop(s) 20 (extended position of the rotary cam 10), so as to obtain and lock the protection position.

The first rotation and the second rotation are performed in the same direction about the longitudinal axis X, preferably with substantially the same angle of rotation.

Referring to FIG. 1, actuating the transition to the protection position of the protective sleeve 3 from the retracted position is illustrated by arrow A. The protective sleeve 3 thus forms a tappet actuating the movement of the rotary cam 10 to alternate between the extended and withdrawn positions.

To achieve this actuation, the user can either grasp the protective sleeve 3 only and push it rearward, for example by placing his fingers in the recesses 25, 26, or can press the writing instrument 1 axially (typically from top to bottom) against a rigid surface. In all cases, this action pushes rearward the assembly formed by the protective sleeve 3 and the rotary cam 10.

The presence of the additional spring R provides a rearward withdrawal of the tip 4*c* into the protection portion 6 so that direct contact can be obtained between the rigid surface and an annular front face 6*b* of this protection portion 6, which then allows pushing the protective sleeve 3 and the rotary cam 10 towards the rear.

Referring to FIG. 1, under the effect of the repulsive force of the additional spring 30 R, the piston P bears against an internal stop 29 of the hollow body 2 for the protection position. This bearing position is also assumed for the retracted position of the protective sleeve 3. The writing member 4 therefore has, in the protection position and in the retracted position, the same position relative to the hollow body 2. It is understood that alternately locking on the first stop(s) B1, B2, B3, B4, B5, B6 and on the second stop(s) 20 allows controlling the sliding of the protective sleeve 3 regardless of whether the writing member 4 is axially movable.

Figure 8:
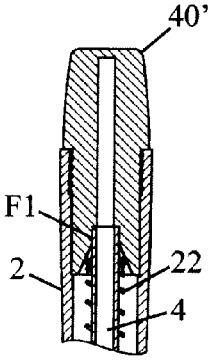
FIG. 8 is a diagram illustrating a longitudinal sectional view of an alternative embodiment of the rear portion of the writing instrument.

In the embodiment in FIG. 8, the writing member 1 does not have the additional spring R. It is understood that in this case the user can specifically grasp the protection portion 6 to push it rearward. The writing member 4 is held in fixed position in the hollow body 2 by bearing against the supporting face F1 formed here at the front end of the plug 40', without sliding. The spring 22 or similar elastic return element operates similarly to the example in FIG. 1.

Referring to FIGS. 4A and 4B, the forward sliding of the guide portion 5 reveals a portion 5*d* connecting with the protection portion 6. At the junction with the protection portion 6, an annular shoulder 28 is provided (see also FIG. 2) which defines a rear face of this protection portion 6. In a preferred embodiment, the protective sleeve 3 can be pushed freely rearward until the annular shoulder 28 presses against the front end 2*b* of the hollow body 2 (end of sliding stroke of the protective sleeve 3). This contact is clearly visible in FIG. 5. The recess 25 may be extended in the longitudinal direction and be deeper than the other recess 26. In the example in FIG. 5, the rear face of the protection portion 6 is angled to enlarge the dimensions of the recess 25.

These recesses 25, 26 facilitate the user grip and therefore facilitate pushing the protective sleeve 3 rearward. It can then be held between two fingers (usually the thumb and index finger) without slipping. This arrangement improves the grip without increasing the radial dimensions of the protection portion 6. Too large of a front end of the writing instrument 1 is generally detrimental to comfortable writing.

Preferably, a single helical spring is provided for biasing the protective sleeve 3. In the non-limiting example in FIG. 1, the length of the spring 22 may be greater than the length of the protection portion 6, the biasing force of the spring 22 in the protection position preferably being significantly lower than the biasing force in the retracted position.

One advantage of the invention lies in the simplicity and ergonomics of the writing instrument: a user can protect the tip 4*c* without actuating a specific actuator. It is also understood that the locking system is compact here, as the general shape of the front portion of the tubular writing instrument 1 can remain thin.

In addition, the design and assembly of the writing instrument 1 are particularly simple, which makes it less expensive to manufacture. It is understood that the rotary cam can be introduced into the inner volume V of the hollow body 2 through the rear end 2*a*, while the protective sleeve 3 is inserted through the opening 2*c* of the front end 2*b*.

The external annular bead 10*a* of the rotary cam 10 engages with the annular retaining groove 5*c* to attach the rotary cam 10 to the guide portion 5 of the protective sleeve 3. Due to plastic deformation of the protective sleeve 3, the annular bead 10*a* can be inserted through the rear end 2*a* where the passage is slightly smaller in diameter than the outer diameter of the annular bead 10*a*.

It is understood that each of the examples and every detail of the embodiments described above may be used alone or in combination.

The invention claimed is:

1. A writing instrument comprising:

a hollow body extending between a rear end and a front end of the hollow body;

a writing member mounted inside the hollow body and provided with a tip at a free end;

a protective sleeve movable between a tip protection position and a retracted position for writing;

at least one first stop formed on the hollow body; and at least one locking member able to engage said first stop, characterized in that the writing instrument further comprises:

at least one second stop formed on the hollow body and axially offset towards the front end with respect to said first stop, the first stop and the second stop being part of a fixed cam;

a rotary cam which comprises said at least one locking member and is movable relative to the hollow body between a withdrawn position where said locking member engages with said first stop in order to lock the retracted position, and an extended position where said locking member engages with said second stop in order to lock the protection position;

an elastic return element for biasing the protective sleeve towards said protection position; and a coupling between the protective sleeve and the rotary cam, so that the protective sleeve forms a tappet actuating a movement of the rotary cam to one or the other of said extended and withdrawn positions in alternation.

2. A writing instrument according to claim 1, wherein the protective sleeve comprises a guide portion sliding along the hollow body on a longitudinal axis of the hollow body, and a protection portion extending said guide portion and having an opening to allow the passage of the tip, the protective sleeve comprising an annular shoulder which defines a rear face of the protection portion, the protective sleeve able to be pushed freely rearward until the annular shoulder presses against the front end of the hollow body.

3. A writing instrument according to claim 2, wherein the protective sleeve comprises a set of teeth adapted to engage with the rotary cam, said coupling allowing a longitudinal rearward displacement of the rotary cam when the protective sleeve is pushed, causing:

in response to the protective sleeve being pushed from said protection position, a first rotation of the rotary cam such that said locking member engages with said first stop, obtaining and locking the retracted position; and in response to the protective sleeve being pushed from said retracted position, a second rotation of the rotary cam such that said locking member engages with said second stop, obtaining and locking the protection position, the first rotation and the second rotation occurring in the same direction about said longitudinal axis with substantially the same angle of rotation.

4. A writing instrument according to claim 2, wherein the front end of the body has an opening, the body defining an inside volume, and the protective sleeve is mounted in the hollow body through said opening, the guide portion of the protective sleeve being inserted into the inside volume of the hollow body and extending longitudinally along the longitudinal axis.

5. A writing instrument according to claim 1, wherein the body defines an inside volume, the elastic return element being a spring located entirely within the inside volume and comprising:

a rear end bearing in a fixed manner against a supporting face; and a front end bearing directly or indirectly against the rotary cam.

6. A writing instrument according to claim 5, wherein the supporting face is formed on a piston, the writing member being rearwardly movable in translation with the piston within the hollow body, an additional spring being arranged near the rear end of the hollow body, bearing on a rear face of the piston opposite the supporting face, in order to generate a repulsive force which biases the writing member towards the front and is adapted to absorb writing pressure when the protective sleeve is in the retracted position.

7. A writing instrument according to claim 6, wherein the effect of the repulsive force of the additional spring causes the piston to bear against an internal stop of the hollow body for said protection position and for said retracted position of the protective sleeve, whereby the writing member has the same position relative to the hollow body in both the protection position and the retracted position.

8. A writing instrument according to claim 4, wherein the rotary cam is positioned within said inside volume and extends annularly around said longitudinal axis, defining an inside space, the writing member being movable in translation along the longitudinal axis within said inside space.

9. A writing instrument according to claim 1, wherein said first stop and said second stop are defined by at least one pair of adjacent notches extending longitudinally on an inner face of the hollow body and opening axially towards the rear in a same annular area of the hollow body, one of the notches of said pair being longer than the other.

10. A writing instrument according to claim 9, wherein said at least one locking member comprises a specified number, at least equal to two, of locking teeth, said inner face of the hollow body having a number of first stops at least greater than or equal to the specified number and the number of second stops being identical to the number of first stops.

11. A writing instrument according to claim 10, wherein the rotary cam is held alternately in either the extended position in which at least one of the locking teeth is engaged with one of the longer notches, or in the withdrawn position in which at least one of the locking teeth is engaged with one of the shorter notches.

12. A writing instrument according to claim 11, wherein the rotary cam comprises a body having a generally cylindrical outer surface extending between a rear end, where said at least one locking member is arranged, and a front end, wherein the protective sleeve has a rear end provided with a set of teeth for engagement with the rotary cam, wherein the protective sleeve has an inner face on which is formed an annular retaining groove, and wherein the rotary cam comprises an external annular bead projecting from said outer surface and engaging said annular retaining groove so that the rotary cam is attached to the protective sleeve with an axial play allowing it to be slidable between a position where the teeth are engaged with the rotary cam and a position where the teeth are disengaged.

13. A writing instrument according to claim 12, wherein the front end of the hollow body has an axial opening, the protective sleeve comprising a guide portion inserted into the inner volume of the hollow body and having a male or female rotation-prevention member for engaging with a complementary guide member of the hollow body extending longitudinally to the front end.

* * * * *